United States Patent [19]

Höffken et al.

[11] Patent Number: 4,604,138

[45] Date of Patent: Aug. 5, 1986

[54] PROCESS FOR REFINING HOT METAL

[75] Inventors: Erich Höffken; Wolfram Florin, both of Dinslaken; Rudolf Hammer, Dinslaken-Eppinghoven, all of Fed. Rep. of Germany

[73] Assignee: Thyssen Stahl AG, Duisburg, Fed. Rep. of Germany

[21] Appl. No.: 774,632

[22] Filed: Sep. 11, 1985

[30] Foreign Application Priority Data

Sep. 22, 1984 [DE] Fed. Rep. of Germany ..... 3434894

[51] Int. Cl.[4] ..... C21C 5/34

[52] U.S. Cl. ..... 75/51.6; 75/59.22

[58] Field of Search ..... 75/51.6, 59.22

[56] References Cited

U.S. PATENT DOCUMENTS

| | | | |
|---|---|---|---|
| 3,714,042 | 1/1973 | Greenough | 252/33.2 |
| 3,813,337 | 5/1974 | Sheldahl | 252/33.4 |
| 3,929,650 | 12/1975 | King et al. | 252/33.4 |
| 4,116,873 | 9/1978 | de Vries | 252/33 |
| 4,119,549 | 10/1978 | Davis | 252/45 |
| 4,264,458 | 4/1981 | Campbell | 252/32.7 |
| 4,326,972 | 4/1982 | Chamberlin, III | 252/33.3 |
| 4,416,788 | 11/1983 | Apikos | 252/31 |
| 4,456,477 | 6/1984 | Masuda | 75/51.6 |
| 4,488,903 | 12/1984 | Mehlman | 75/51.6 |
| 4,505,830 | 3/1985 | Vinci | 252/33 |

FOREIGN PATENT DOCUMENTS

| | | | |
|---|---|---|---|
| 1505700 | 6/1979 | Canada | 44/10 |

*Primary Examiner*—Peter D. Rosenberg

*Attorney, Agent, or Firm*—Sprung, Horn, Kramer & Woods

[57] ABSTRACT

The invention relates to a process for producing steel of low phosphorus content from hot metal of usual phosphorus content, in which the hot metal is simultaneously decarburized and dephosphorized in a single process step in a metallurgical vessel, in particular in a converter. The refining gas consisting predominantly or completely of technically pure oxygen is top-blown into the melt, particularly from below. The vessel is charged with hot metal containing manganese in an amount of less than 0.2% by weight. Lime is then added and refining is carried out down to a final phosphorus content of 0.005% by weight or less in the steel at the end of blowing, without a change of slag.

3 Claims, No Drawings

PROCESS FOR REFINING HOT METAL

The invention relates to a process for producing steel of low phosphorus content from hot metal of usual phosphorus content, in which the hot metal is simultaneously decarburised and dephosphorised in a single process step in a metallurgical vessel, in particular a converter, in which refining gas consisting predominantly or completely of technically pure oxygen is top-blown onto the melt and, an inert stirring gas is blown into the melt.

It is well known that phosphorus exerts an unfavorable effect on the properties of steel. Apart from certain steel grades in which phosphorus is deliberately added as an alloying element, a low final phosphorus content of the order of magnitude of about 0.010 to 0.030% by weight is desired in most steel grades. Such phosphorus contents can be set by the abovementioned known blowing processes.

German Offenlegungsschrift No. 3,318,332 has disclosed a process for further reducing the phosphorus content, by charging a converter with desiliconised hot metal and top-blowing refining oxygen together with a slag-forming material onto the hot metal and simultaneously blowing a gas from the group comprising inert gas, nitrogen, oxygen, carbon monoxide, carbon dioxide or mixtures thereof from below into the melt. In this refining process, the target is a final phosphorus content of 0.010% by weight and less.

The disadvantages of this process are a large temperature drop of the melt, the production of additional quantities of slag which must be passed to additional reprocessing, and increased iron losses as well as a higher consumption of refractory material.

According to a process known from German Offenlegungsschrift No. 2,842,563, $CaCO_3$ and $Na_2CO_3$ in a 1:1 ratio with an addition of fluorite and/or iron oxide each in a quantity of up to 30% by weight of the carbonate mixture are introduced into the effervescent molten steel in the refining vessel, after or just before the end of the conventional refining process, that is to say in the region of a carbon content of less than 0.4% by weight and after extensive removal of the refining slag, by means of a carrier gas into the melt to such a depth that the entire slag is thoroughly mixed, and the steel is then tapped, while holding the treatment slag back, and finished in the ladle in a manner known per se. In this way, phosphorus contents in the steel of less than 0.001% by weight are said to be achievable.

In a further process known from German Offenlegungsschrift No. 3,245,098, the steel in the converter is not dephosphorised, or only to an insignificant extent, after the decarburisation and is then poured off at a temperature, such as is established largely after the combustion of the carbon, into a heatable ladle into which dephosphorising agents are then blown in a manner known per se.

The disadvantages of these two known processes again are that additional quantities of slag are obtained which must be reprocessed by expensive processes or transported to a tip. In addition, large temperature drops again result from the addition of slag formers which prevent the addition of scrap.

It is the object of the invention to lower the usual phosphorus content of hot metal which as a rule is up to 0.2% by weight to less than 0.005% by weight during a singlestage combined blowing/refining process without additional costs.

Starting from a process of the generic type described at the outset, this object is achieved according to the invention when the vessel is charged with hot metal of a manganese content of less than 0.2% by weight and refining is carried out down to a final phosphorus content of 0.005% by weight or less in the steel at the end of blowing.

In the known combined blowing processes, in which oxygen is top-blown and a stirring gas is blown into the melt from below, the manganese content of the hot metal employed is in general about 0.4 to 0.8% by weight, see for example the German journal "Stahl und Eisen" 104 (1984) No. 16, pages 767 to 773. FIG. 6 on page 769 shows a manganese content of the hot metal employed of about 0.50 to 0.60%. Depending on the converter size, the final phosphorus content after refining is between 0.020 and 0.010%, as shown, for example, by FIGS. 4, 9 and 12 on pages 769 to 771 in the German journal "Stahl und Eisen" 103 (1983) No. 4, pages 163 to 165, with reference to another combined blowing process, a mean manganese content of the hot metal of 0.29% is described as a very low value (page 165, lefthand column, first paragraph, and FIG. 5). The final phosphorus contents obtained in the steel are not to be found in this publication.

The invention is now based on the discovery that, when a hot metal of manganese content of less than 0.2% by weight is employed, final posphorus contents of 0.005% by weight and less after refining can be achieved. This becomes possible without incurring disadvantages inherent in the known processes.

Hitherto, the view prevailed in expert circles that manganese contents of the order of magnitude of 0.4 to 0.8% by weight in the hot metal employed are necessary to enable a blowing process to be carried out. These manganese contents in the hot metal were intended to prevent the establishment of excessive iron contents of more than 20% on average in the slag at the end of blowing. Due to the manganese content restricted according to the invention to 0.2% by weight in the hot metal, however, the added lime can suprisingly be activated, favored by iron oxidation at an early stage, and the oxidation of phosphorus from the melt can thus be accelerated and the phosphoric acid ($P_2O_5$) formed can be fixed in a stable form in the slag at an early stage.

The hot metal feed of lowered manganese content can be obtained without difficulties and without costs by the use of inexpensive ores of low manganese content in the blast furnace and by omission of the re-use of manganese-containing steels works slags in the blast furnace stock.

It is regarded as a particular advantage of the process according in the invention that the low final phosphorus contents can be reached in a single process step. This means that separate pre-dephosphorisation is unnecessary.

If, according to a preferred embodiment of the process according to the invention, hot metal of a silicon content of 0.15 to 0.35% by weight, preferably less than 0.30% by weight, is employed, a further advantage results with respect to a reduction in the required quantity of lime, which can amount to 20 to 40 kg per ton of hot metal in the quantity of slag obtained. Within the indicated range, the lower quantity of lime corresponds to the lower silicon content.

Thus, the hot metal can, at a low silicon and manganese content, such as is obtained from the blast furnace process, be refined immediately afterwards in a single blowing step without an upstream dephosphorisation and without a change of slag down to low carbon, sulphur and, in particular, phosphorus contents.

In this process in a metallurgical vessel, particularly a converter, technically pure oxygen is blown by a top-lance onto the melt. At the same time an inert stirring gas is blown into the melt from below. This can be done from the start of the topblowing oxygen permanently or temporarily until the tapping of the refined steel. In the case of temporary blowing the inert stirring gas has to be blown especially in the first and the last 30% of the total blowing time.

The invention is explained in more detail by reference to the following examples:

EXAMPLE 1

330 tons of hot metal with a composition of:

4.60% by weight carbon—0.08% by weight phosphorus 0.17% by weight manganese—0.018% by weight sulfur 0.35% by weight silicon—remainder iron are charged at a temperature of 1,344° C. to a converter together with 96 tons of scrap. The refining gas was technically pure oxygen which was top-blown onto the melt. The added quantity of lime was 51 kg per ton of hot metal.

From the start of top-blowing oxygen until the tapping of the finished steel, argon as a stirring gas was blown into the melt from below at a rate of 0.03 $m^3$ (S.T.P.) per ton/minute on average. The temperature at the end of blowing was 1,640° C. A sample taken at the end of blowing had the following composition:

0.029% by weight carbon—0.005% by weight phosphorus 0.07% by weight manganese—0.010% by weight sulfur remainder iron The quantity of slag was 99 kg per ton of hot metal, at an iron content of the slag of $Fe_{tot}$=16.9% by weight.

EXAMPLE 2

316 tons with a composition of:

4.68% by weight carbon—0.08% by weight phosphorus 0.16% by weight manganese—0.019% by weight sulfur 0.24% by weight silicon—remainder iron were charged at a temperature of 1,300° C. to a converter together with 95 tons of scrap.

The refining gas used was again technically pure oxygen which was top-blown onto the melt. The added quantity of lime was 31 kg per ton of hot metal.

From the start until the end of top-blowing oxygen, argon as the stirring gas was blown into the melt from below, on average 0.03 $m^3$ (S.T.P.) per ton/minute. The temperature of the melt at the end of blowing was 1,630° C. A sample taken at the end of blowing had the following composition:

0.025% by weight carbon—0.004% by weight phosphorus 0.08% by weight manganese—0.017% by weight sulfur remainder iron The quantity of slag was 79 kg per ton of hot metal at an iron content of the slag of $Fe_{tot}$=17.9% by weight.

EXAMPLE 3

In this comparative example not covered by the invention, 305 tons of hot metal with a composition of:

4.60% by weight carbon—0.10% by weight phosphorus 0.61% by weight manganese—0.019% by weight sulfur remainder iron were charged at a temperature of 1,340° C. to a converter together with 105 tons of scrap.

The refining gas used was technically pure oxygen which was top-blown onto the melt. The added quantity of lime was 54 kg per ton of hot metal.

From the start of top-blowing oxygen until the tapping of the finished steel, argon as the stirring gas was blown into the melt from below at a rate of 0.03 $m^3$ (S.T.P.) per ton/minute. The duration of blowing was 18 minutes. The temperature of the melt at the end of blowing was 1,625° C. A sample of the melt taken at the end of blowing has the following composition:

0.026% by weight carbon—0.011% by weight phosphorus 0.22% by weight manganese—0.011% by weight sulfur remainder iron The quantity of slag was 111 kg per ton of hot metal at an iron content of $Fe_{tot}$=18.50% by weight.

Contrasting the results from comparative Example 3 with Examples 1 and 2 according to the invention, it is seen that, when charging the converter with hot metal of manganese contents of less than 0.20% by weight, the final phosphorus contents can be lowered to 0.005% by weight and less, at approximately the same initial phosphorus contents. At the same time, increased slagging of iron or other process disadvantages do not arise. Furthermore, the quantities of lime employed can be further reduced if the Si content in the hot metal is lowered (see Example 2). As a result, the quantity of slag obtained is reduced. A further advantage over the comparative example is that the blowing process proceeds without effervescence and the known ejection of slag and steel is very largely eliminated.

The process according to the invention is suitable for refining low-phosphorus hot metal with an initial phosphorus content from 0.02 to 0.2% by weight preferably up to 0.15% by weight.

The lime is added in lump form (8 to 40 mm) at the start of the blowing process. The quantity of lime added when the process according to the invention is carried out depends essentially on the silicon content and is not greater than when the process of the generic type is carried out without the measures according to the invention.

The temperature at the end of blowing should be at most 1,650° C.

In the process according to the invention, no fluxes, such as fluorite or alumina, are added to the slag.

It is understood that the specification and examples are illustrative but not limitative of the present invention and that other embodiments within the spirit and scope of the invention will suggest themselves to those skilled in the art.

We claim:

1. In the production of steel of low phosphorus content from hot metal having a phosphorus content up to 0.2% by weight, wherein a refining gas comprising oxygen is top-blown onto a steel-producing melt and an inert stirring gas is blown into the melt, the improvement which comprises employing a melt having a manganese content of less than 0.2% by weight, adding lime to the melt and continuing refining down to a final phosphorus content of at most 0.005% by weight in the steel at the end of blowing, without a change of slag, whereby the steel is simultaneously decarburised and dephosphorised.

2. A process according to claim 1, wherein the melt initially has a silicon content of 0.15 to 0.35% by weight, and 20 to 40 kg of lime per ton of crude steel are added during refining.

3. A process according to claim 1, wherein the inert stirring gas is blown into the melt from below.

* * * * *